United States Patent [19]

Dunning et al.

[11] Patent Number: 4,872,084

[45] Date of Patent: Oct. 3, 1989

[54] ENHANCED ELECTRICAL SHOCKING DEVICE WITH IMPROVED LONG LIFE AND INCREASED POWER CIRCUITRY

[75] Inventors: Brian Dunning, Canoga Park, Calif.; A. R. Mansfield, Provo, Utah

[73] Assignee: U.S. Protectors, Inc., Canoga Park, Calif.

[21] Appl. No.: 240,740

[22] Filed: Sep. 6, 1988

[51] Int. Cl.[4] ..... H01T 14/00

[52] U.S. Cl. ..... 361/232; 231/7; 273/84 ES

[58] Field of Search ..... 361/232, 235; 231/7; 273/84 ES

[56] References Cited

U.S. PATENT DOCUMENTS 3,885,733 5/1975 Klebold et al. ..... 361/232
3,998,459 12/1976 Henderson et al. ..... 273/84 ES
4,162,515 7/1979 Henderson et al. ..... 361/232

*Primary Examiner*—L. T. Hix
*Assistant Examiner*—David M. Gray
*Attorney, Agent, or Firm*—Thomas I. Rozsa

[57] ABSTRACT

An improved stun-gun or electrical shock device which includes improved circuit elements to eliminate the frequent product failure due to corrosion and pitting of an internal spark gap as found in prior art electrical shocking devices. The conventional internal spark gap found in prior art stun-guns is replaced with a pair of surge arrestors, thereby eliminating the problems caused by corrosion and pitting of the internal spark gap which has caused prior art stun-guns to have a limited life and fail.

8 Claims, 1 Drawing Sheet

ENHANCED ELECTRICAL SHOCKING DEVICE WITH IMPROVED LONG LIFE AND INCREASED POWER CIRCUITRY

BACKGROUND OF THE INVENTION

1. FIELD OF THE INVENTION

The present invention relates to the field of apparatus generally known as stun-guns. Such devices provide an electrical shock when the probes forming a gap across which an electrical shock charge is transmitted is brought into contact with an assailant. The overall intent of such stun-guns is to provide a non-fatal shock to an assailant in order to cause the assailant to become temporarily disoriented and provide sufficient time for the would-be victim to call for help and escape from further attack.

2. DESCRIPTION OF THE PRIOR ART

In general, stun-gun or electrical shock devices are well known in the prior art and have been commercially available for many years. In general, most commercially available models are similarly designed and have the following primary components: (1) an exterior case which is made of non-conductive material and can be conveniently held in the palm of one hand and gripped by the fingers of that hand; (2) an electronic circuit and a source of power contained within the case; (3) a pair of external conductive plates supported by the exterior case and connected to the interior electronic circuit, which when energized causes a generally continuous spark to jump between the pair of external conductive plates, thereby providing the source of shock.

An example of such an electrical shocking device is disclosed in U.S. Pat. No. 4,162,515 issued to Henderson et al in 1979 for "Electrical Shocking Device With Audible And Visible Spark Display" ("'515 Patent"). The disclosure in the '515 Patent illustrated and described is a battery powered, hand-held, lightweight electrical shocking device which provides a visible and audible display of sparks continuously upon the operation of a switch. The device is capable of delivering a jolting shock. The device in the '515 Patent is comprised of a non-conductive housing in a generally annular shape, permitting it to be gripped in one hand. On one surface away from the hand are first and second conductive plates separated from each other by an insulator. The electrical circuit comprises a free-running multi-vibrator, a small transformer, a rectifier a voltage doubler and an internal spark gap. The circuit can deliver a series of short duration, high voltage, low current electrical shocks from two penlight batteries. While the device in the '515 Patent works, it has a major technical flaw which causes it to fail frequently and also have a limited overall useful life. The use of an internal spark gap as part of the circuitry which generates the electrical shock provides an element which creates a source of humidity and corrosion. The elements of the internal spark gap, designated as number 66 in the '515 patent frequently corrode or pit, thereby causing the entire circuit and device to fail. In addition, the use of the internal spark gap limits the power of the electrical shock, thereby reducing the effectiveness of the entire device.

Therefore there is a significant need in the marketplace for a device which improves and enhances the known prior art by eliminating the standard spark gap used in the device of the '515 patent and substituting therefor circuit elements which will not pit or corrode and therefore provide the device with a much longer useful life. In addition, there is a significant need for improved circuit elements which will provide enhanced power output and stronger non-fatal electrical shock, to thereby create a more effective stun-gun and attack deterrent device.

SUMMARY OF THE PRESENT INVENTION

The present invention is an improved stun-gun or electrical shock device which includes improved circuit elements to eliminate the frequent product failure due to corrosion and pitting of an internal spark gap as found in prior art electrical shocking devices.

The present invention is a battery powered, hand-held, lightweight electrical shocking device which can provide both a visible display of generally continuous sparks between a pair of external plates or probes. The device is comprised of a non-conductive housing preferably formed in a generally pistol grip shape to facilitate the device being securely held in the hand and thereby prevent it from being easily knocked out of the user's hand by an assailant. The device further comprises a specialized circuit board onto which are secured the electrical circuit elements used to create the shock charge. The circuit is powered by a power source such as a 9 volt DC battery housed in a separate chamber within the housing. The circuit is also connected to a pair of external plates or probes have a gap between them and which are supported by the housing and are located at the front end of the housing so that the device may be securely held in the user's hand while the shocking probes can be pointed at and touch the assailant.

It has been discovered according to the present invention, that if the conventional internal spark gap found in prior art stun-guns is replaced with a pair of surge arrestors, then the problems caused by corrosion and pitting of the internal spark gap which has caused prior art stun-guns to have a limited life and fail have been eliminated and the new improved stun-gun has a much longer life.

It has been further discovered that if the newly added pair of surge arrestors is comprised of one 800 volt medium duty surge arrestor matched with a 6.8 ohm resistor and one 600 volt medium duty arrestor matched with 5.1 ohm resistor, this combined pair of surge arrestors provides maximum non-fatal stunning power for use with a 9 volt battery, providing a 1400 volt charge and further creating the stun spark between the plates or probes of the device for an extended period of time without creation of humidity, corrosion and pitting, thereby providing the new improved stun-gun with a much longer useful life as well as increased stunning power. In addition, such improved components serve to better hold the stun charge.

Most prior art stun-guns have their shocking probes in a generally "L" shaped design wherein the two probes are mirror images of each other with the two shorter branches of the "L" separated by a small gap and the elongated portions extend forward of the casing and are separated by a wider gap. The shorter gap formed by the oppositely facing shorter branches of the "L" create an audible sound as well as a spark while the spark created between the forwardly extending probes creates the stun to disorient the would-be attacker. It has been discovered, according to the present invention, that this prior art design creates a sufficiently low voltage on the stunning portion of the probes to significantly reduce its effectiveness. The stun in many cases is so weak that it cannot penetrate through clothing. It has been discovered, according to the present invention, that if the "L" shaped probes are replaced by a pair of straight probes or plates which are generally oriented at an angle in the range of thirty (30) degrees to seventy (70) degrees to the horizontal such that the probes extend forward of the casing and are closest at their forwardmost points farthest from the housing, then the voltage of the stun is significantly enhanced and is essentially imparted fully to the would be attacker, thereby achieving a much more effective stun-gun which can penetrate clothing.

It has further been discovered, according to the present invention, that if the stun-gun has incorporated into it a "kill" switch which is attached to a loop around the casing and can be worn around a person's hands as the person holds the stun-gun, then if the stun-gun is knocked out of the person's hand, the relative motion of the stun-gun to the loop causes the loop to pull on the "kill" switch, thereby killing the stun-gun and making it inoperable. In this way, the attacker cannot use the stun-gun against its owner.

It is therefore an object of the present invention to provide a stun-gun or electrical shock device which overcomes the shortcomings of prior art stun-guns.

It is another object of the present invention to provide a stun-gun with an improved pistol-grip design to facilitate the stun-gun being securely held in the hand of the user and reduce the likelihood that it can be knocked out of the user's hand by the assailant.

It is a further object of the present invention to provide a stun-gun which has a substantially greater useful life over prior art stun-guns by eliminating the internal circuit open spark gap found in the prior art stun-guns, thereby eliminating the primary source of humidity, corrosion and pitting which caused such prior art stun-guns to fail.

It is an additional object of the present invention to provide a long life stun-gun which can obtain the maximum useful non-fatal stunning power with a 9 volt battery.

It is also an object of the present invention to provide a stun-gun which has increased voltage power of the stunning plates to enable the stun to penetrate the clothing of a would-be attacker.

It is also an object of the present invention to provide a stun-gun which can be inactivated if the stun-gun should be knocked out of the user's hand.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
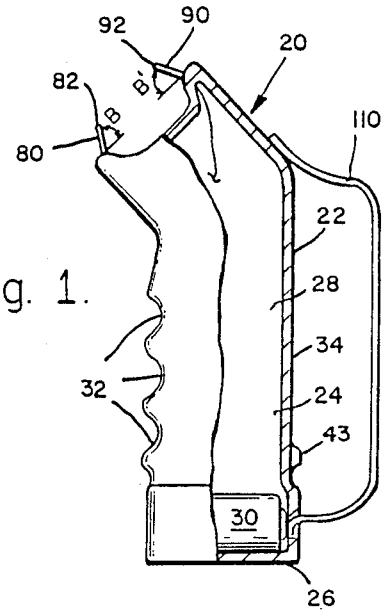
FIG. 1 is a side elevational view in partial cross-section of the present invention stun-gun, showing its improved pistol grip design.

Referring to FIG. 1, the present invention stun-gun is shown as 20 and is comprised of a housing 22 which is formed from any type of material that is non-conductive. Due to its light weight, plastics are preferred non-conductive material for the housing 22. In interior 24 of the housing 22 includes several chambers. Located at the rearwardmost portion of the housing is a power unit chamber 26 which contains a power unit 30 therein. The preferred power unit 30 is a 9 volt DC battery, but other types of power units such as one or more A, B, and C or D cell batteries may be used. The 9 volt battery is preferably rechargeable since the high voltage required for the stun serves to drain the battery. A large interior chamber 28 houses the electronic circuitry, connected to the power unit 30 at one end and to the shocking plates or probes 80 and 90 at its other end, the probes being located at the forward end of the housing 22. First shocking plate or probe 80 may be an electrode plate formed of a single elongated plate and oriented inwardly toward the centerline of the housing at an angle "B" which may be in the range of 30 degrees to 80 degrees and is preferably about 60 degrees. Second shocking plate or probe 80 may be an electrode plate formed of a single elongated plate and oriented inwardly toward the centerline of the housing at an angle "B," which may be in the range of 30 degrees to 80 degrees and is preferably about 60 degrees. As illustrated in FIG. 1, the two plates or probes 80 and 90 are aligned toward each other as they extend form the housing 12. A spark and stun is generated between tip 82 of probe 80 and tip 92 of probe 90. As further illustrated in FIG. 1, the housing 12 has a series of grooves 32 along one edge and is generally straight along its opposite end 34, thereby creating a "pistol grip" design which enables the stun-gun to be more securely held, with the straight edge 34 resting against the palm of the user's hand while the user's fingers are wrapped around the grooves 32.

Figure 2:
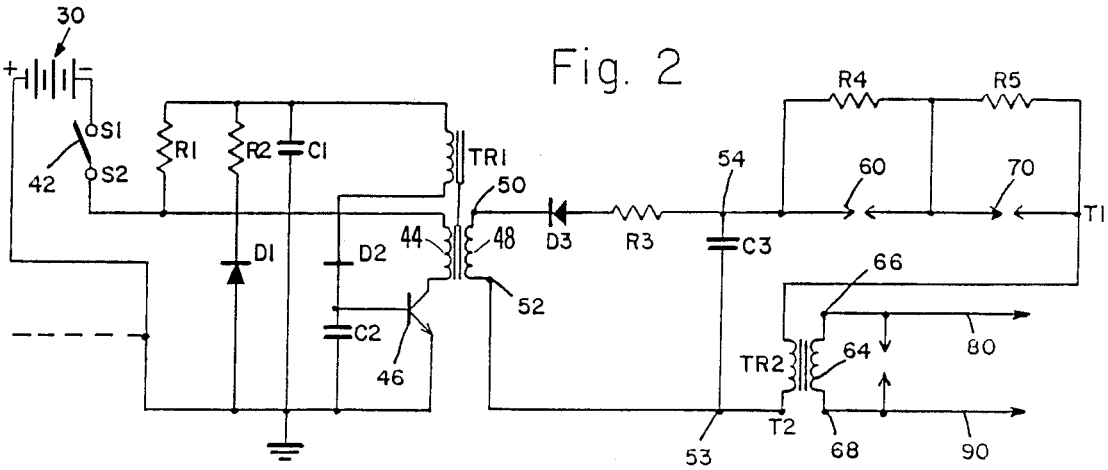
FIG. 2 is a circuit diagram of the improved electronic circuitry of the present invention.

The electronic circuit means 40 for the present invention stun-gun 20 is shown in FIG. 2. The power source 30 is connected to an on-off switch 42 which in turn is connected to an activating means 43 on the housing 22 which can be caused to close the switch 42. Such activating means 43 may be a push button or slide button. Connector means 44 such as conventional electronic wire or conduction surfaces through a printed circuit board connect the power source 30 to the on-off switch 42 which in turn is connected a first resistor R1. First resistor R1 is connected in series to second resistor R2. Second resistor R2 is connected in parallel to capacitor C1. Resistor R1 may be a 2.2. kiloohm resistor and resistor R2 may be an 8.2 ohm resistor. Capacitor C1 may be a 0.1 microfarad 16 volt or greater capacitor. Resistor R2 is connected to first Diode D1. Diodes D1 and D2 may each be IN4006 diodes. Diode D1 is connected to ground. Capacitor C1 is connected to ground. Resistor R2 and capacitor C1 are connected in parallel and diode D2 is connected in series to inverter transformer TR1. Diode D2 is also connected to capacitor C2 which in turn is connected to ground. Capacitor C2 may also be a 0.1 microfarad 16 volt or greater capacitor. The primary winding 44 of inverter transformer TR1 is connected to a transistor 46 which may be a Texas Instruments TIP41B transistor. The transistor 46 may in turn be connected to ground.

Inverter transformer TR1 which is a standard item such as that manufactured by Vitec Co. also has a secondary winding 48 having two end terminals 50 and 52. Secondary winding 48 is connected in series through end terminal 50 to a third diode D3 which may be an R3000 diode. Diode D3 is in turn connected in series to third resistor R3 which may be a 1 kiloohm ¼ watt resistor. A third capacitor C3 is connected in parallel with inverter transformer TR1, with diode D3 and resistor R3 lying between end terminal 50 and the capacitor C3 while end terminal 52 is directly connected to capacitor C3. Capacitor C3 may be a 0.42 microfarad 2000 volt metal film capacitor.

Capacitor C3 is connected in parallel to first medium duty surge arrestor 60 which in turn is connected in series to second medium duty surge arrestor 70. A fourth resistor R4 is connected in parallel with first medium duty surge arrestor 60 and a fifth resistor R5 is connected in parallel with second medium duty surge arrestor 70. The surge arrestors will be described in greater detail below. First medium duty surge arrestor 60 may be a 600 volt surge arrestor and second medium duty surge arrestor 70 may be an 800 volt surge arrestor. Resistor R4 may be a 5.1 Megaohm ¼ watt resistor and resistor R5 may be a 6.8 Megaohm ¼ watt resistor.

Second medium duty surge arrestor 70 is connected in series to a high voltage transformer TR2 which may be a 75,000 volt high voltage coil. High voltage transformer TR2 is also connected in parallel with capacitor C3 and inverter transformer TR1. High voltage transformer TR2 also has a secondary winding 64 having two end terminals 66 and 68. End terminal 66 is connected in series to first charge plate or probe 80 and end terminal 68 is connected in series to second charge plate or probe 90.

Figure 3:
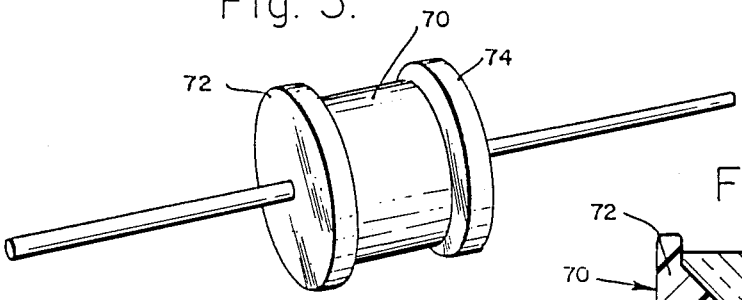
FIG. 3 is a perspective view of the surge arrestor used in conjunction with the circuitry of the present invention.
Figure 4:
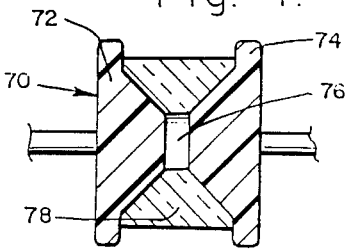
FIG. 4 is a cross-sectional view taken along line 4—4 of FIG. 3.

As previously described, the use of medium duty surge arrestors in place of a conventional internal series spark gap lends a significant improvement to the present invention in that corrosion and pitting of the plates of the interior spark gap is eliminated through the sealed surge arrestors. The first medium duty surge arrestor 60 may be a Lumex Part Number GT-BG600L surge arrestor and the second medium duty surge arrestor 70 may be a Lumex Part Number GT-BG800L surge arrestor. A perspective view of such medium duty surge arrestor is shown in FIG. 3 and a cross-sectional view thereof is shown in FIG. 4. The description will be with respect to second surge arrestor 70, but also is the same for first surge arrestor 60. Second surge arrestor 70 comprises outer generally parallel circular plates 72 and 74, spaced apart to form a gap 76 between them. Plates 72 and 74 may be made of Kovar. The gap 76 is in turn sealed by a cylindrical wall of material 78 which may be hard glass. The initial spark is generated within the sealed surge arrestor and the interior of plates 72 and 74 are sealed within the outside wall 78 so that humidity cannot enter the gap 76 and the plates will not corrode or pit.

Figure 5:
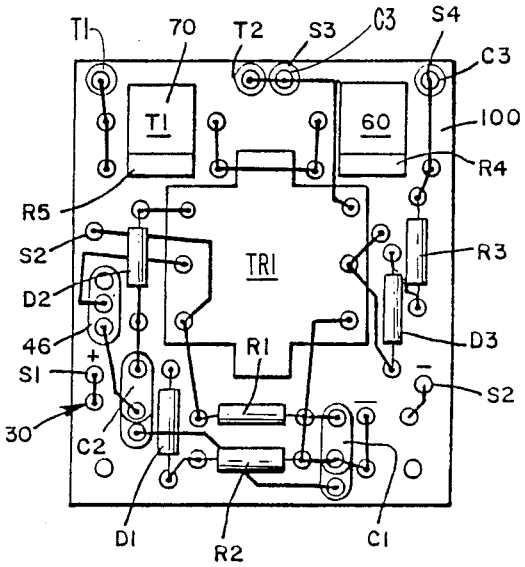
FIG. 5 is a plan view of the circuit board to which the circuit elements of the present invention are attached.

A plan view of the circuit board 100 to which the elements of the circuit and the power source are attached is shown in FIG. 5. Locations in the circuit of FIG. 2, designated as S1, S2, S3, S4, T1 and T2 are also shown on the circuit board in FIG. 5. The circuit board is placed inside interior chamber 28, using the housing 22 as the ground.

An additional enhancement of the present invention involves utilization of a specialized mechanism to disarm the stun-gun in the event it is knocked out of the user's hand Referring to FIG. 1 a strap 110 is attached to the straight edge 34 of the housing 22 and is attached by a coupling mechanism to the switch 42. In use, the stun-gun 20 is held in the palm of the user's hand with the user's fingers wrapped around the grooves 32 and the strap 110 wrapped around the back of the user's hand. The user's hand is therefor sandwiched between the housing 22 and the strap 10. If the stun-gun is knocked out of the user's hand by the assailant, the force of the stun-gun flying out of the user's hand creates a pulling effect on the pin connected from the strap 110 to the on-off switch 42 and causes the on-off switch to open and the contact to break, thereby inactivating the stun-gun. In ordinary operation, the user closes the on-off switch 42 with a push or slide button 43 on the housing 22 but this specialized pin will break the contact and prevent the stun-gun from being turned on through use of the switch closing mechanism.

Therefore, through use of the present invention, and in particular the use of the medium duty surge arrestors to cause the internal circuit spark, the circuit for the present invention has a much longer useful life and is capable of drawing the maximum voltage power of 1400 volts from a 9 volt battery. The use of the single spark plates 80 and 90 which are set an angle toward each other and are separated by a smaller gap at their tips than at their base provides maximum stunning power which can penetrate the clothes of a would-be assailant. With the distance between the tips of the plates or probes 80 and 90 being approximately 1.25 inches, the voltage stunning power of the present invention can be as much as 52,000 volts per inch or 65,000 volts over the one and a half inch gap. Therefore, the improvement of the present invention provide a substantially enhanced stun-gun with important improvements over the prior art.

The present invention further comprises an activating switch on said housing member for closing the on-off switch in the electronic circuit.

The stun-gun also includes a plurality of grooves along one edge to thereby enable it to be gripped with the opposite edge resting in the palm of the user's hand and the user's fingers wrapped around the grooves.

The stun-gun further comprises a strap mechanism connected to a deactivating mechanism whereby the strap is wrapped around the back of the user's hand and if the stun-gun is knocked loose from the user's hand, the pulling motion on the strap causes it to trigger the deactivation mechanism and cause the stun-gun to become inoperable.

The first conducting probe is set at an angle between 30 degrees and 80 degrees relative to the horizontal front of the housing member and extends from adjacent one edge of the housing member inwardly toward the longitudinal centerline of the stun-gun and toward the second conducting probe.

The said second conducting probe is set at an angle between 30 degrees and 80 degrees relative to the horizontal front of the housing member and extends from adjacent one edge of the housing member inwardly toward the longitudinal centerline of the stun-gun and toward the first conducting probe.

The distance between the tips of the first conducting probe and the second conducting probe can be approximately 1.25 inches.

Overall, the unit is design to run at 0.42 microfarads while most units run at 0.47 microfarads. The mini-joule rate of the present invention is in the range of 0.40 to 0.44 while the mini-joule rate of prior art inventions is in the range of 2.8 to 3.5. The present invention is therefore a more powerful unit.

Of course the present invention is not intended to be restricted to any particular form or arrangement, or any specific embodiment disclosed herein or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A hand held stun-gun which is the energized, operative condition produces a visible external spark and is capable of delivering a powerful but non-fatal electrical shock, comprising:

a. a non-conductive hollow housing member having a front end, a rear end, a pair of edges and an internal chamber;

b. a low voltage power source positioned within the internal chamber of said housing member;

c. an electronic circuit, located within said interior chamber and connected to said low voltage power source, comprising:

(i) an on-off switch connected in series to the low voltage power source, (ii) a first resistor connected in series to the on-off switch, (iii) a second resistor, (iv) a first capacitor connected to ground, (v) the second resistor connected in series to a first diode which in turn is connected to ground, (vi) the series combination of the second resistor and first diode connected in parallel to said first capacitor, (vii) the series combination of the second resistor and first diode connected in series to said first resistor, (viii) an inverter transformer connected to the first capacitor, to a second diode and to a transistor, (ix) the second diode connected to a second capacitor which in turn is connected to ground, (x) the transistor connected to the second diode and also connected to ground, (xi) the inverter transformer having a secondary winding including a first and second terminal, (xii) the first terminal of the secondary winding of the inverter transformer connected in series to a third diode which is turn is connected in series to a third resistor, (xiii) a third capacitor connected in parallel with the inverter transformer, with the third diode and third resistor between the first terminal and the third capacitor, (xiv) the third capacitor also connected in parallel to a first medium duty surge arrestor which in turn is connected in parallel to a fourth resistor, (xv) the first medium duty surge arrestor also connected in series to a second medium duty surge arrestor which in turn is connected in parallel to a fifth resistor, (xvi) the second medium duty surge arrestor connected in series to a high voltage transformer which is also connected in parallel to the third capacitor, (xvii) the high voltage transformer having a secondary winding having a first end terminal and a second end terminal;

d. a first conductive probe connected to the first end terminal of the secondary winding of the high voltage transformer, the probe supported adjacent the front of the housing member;

e. a second conductive probe connected to the second end terminal of the secondary winding of the high voltage transformer, the probe supported adjacent the front of the housing member; and f. the first and second conductive probes separated by a gap at their attachment locations to the housing and protruding forward at an angle from end of the housing such that the two probes are separated by a smaller gap at their tips;

g. whereby when energized, the low voltage power source and electronic circuitry causes a generally continuous higher non-fatal voltage to be transmitted between the tips of the first and second conductive probes.

2. The stun-gun in accordance with claim 1, wherein:

a. said power source is a 9 volt DC battery;

b. said first resistor is a 2.2 kiloohm resistor;

c. said second resistor is an 8.2 ohm resistor;

d. said first capacitor is a 0.1 microfarad 15 volt or greater capacitor;

e. said first diode is a IN4006 diode;

f. said second diode is a IN4006 diode;

g. said second capacitor is a 0.1 microfarad 16 volt or greater capacitor;

h. said transistor is a TIP41B transistor;

i. said third diode is an R3000 diode;

j. said third resistor is a 1 kiloohm $\frac{1}{4}$ watt resistor;

k. said third capacitor is a 0.42 microfarad 200 volt metal film capacitor;

l. said first surge arrestor is a 600 volt medium duty surge arrestor;

m. said fourth resistor is a 5.1 megaohm $\frac{1}{4}$ watt resistor;

n. said second surge arrestor is an 800 volt medium duty surge arrestor;

o. said fifth resistor is a 6.8 megaohm $\frac{1}{4}$ watt resistor; and p. said high voltage transformer is a 75,000 volt high voltage coil.

3. The stun-gun in accordance with claim 1 further comprising an activating switch on said housing member for closing the on-off switch in the electronic circuit.

4. The stun-gun in accordance with claim 1 wherein the stun-gun has a plurality of grooves along one edge to thereby enable it to be gripped with the opposite edge resting in the palm of the user's hand and the user's fingers wrapped around the grooves.

5. The stun-gun in accordance with claim 1 further comprising a strap mechanism connected to a deactivating mechanism whereby the strap is wrapped around the back of the user's hand and if the stun-gun is knocked loose from the user's hand, the pulling motion on the strap causes it to trigger the deactivation mechanism and cause the stun-gun to become inoperable.

6. The stun-gun in accordance with claim 1 wherein said first conducting probe is set at an angle between 30 degrees and 80 degrees relative to the horizontal front of the housing member and extends from adjacent one edge of the housing member inwardly toward the longitudinal centerline of the stun-gun and toward the second conducting probe.

7. The stun-gun in accordance with claim 1 wherein said second conducting probe is set at an angle between 30 degrees and 80 degrees relative to the horizontal front of the housing member and extends from adjacent one edge of the housing member inwardly toward the longitudinal centerline of the stun-gun and toward the first conducting probe.

8. The stun-gun in accordance with claim 1 wherein the distance between the tips of the first conducting probe and the second conducting probe is approximately 1.25 inches.

* * * * *